US011549732B2

(12) United States Patent
Muller et al.

(10) Patent No.: US 11,549,732 B2
(45) Date of Patent: Jan. 10, 2023

(54) REFRIGERATION APPARATUS HAVING SUBCOOLING HEAT EXCHANGER FOR LUBRICATION FLOW

(71) Applicant: Carrier Corporation, Palm Beach Gardens, FL (US)

(72) Inventors: Raphael Muller, Lyons (FR); Jeremey Wallet-Laily, Saint Cyr au mont d'Or (FR); Charbel Rahhal, Lyons (FR); Antoine Barriere, Villeurbanne (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 30 days.

(21) Appl. No.: 15/930,039

(22) Filed: May 12, 2020

(65) Prior Publication Data

US 2020/0370797 A1 Nov. 26, 2020

(30) Foreign Application Priority Data

May 21, 2019 (EP) ..... 19175782

(51) Int. Cl.
*F25B 31/00* (2006.01)
*F25B 40/02* (2006.01)

(52) U.S. Cl.
CPC ..... *F25B 31/002* (2013.01); *F25B 40/02* (2013.01); *F25B 2500/16* (2013.01)

(58) Field of Classification Search
CPC ..... F25B 31/002; F25B 31/004; F25B 40/02; F25B 2500/16; F25B 2400/051; F25B 2400/053
USPC ..... 62/84, 192, 519, 524
See application file for complete search history.

(56) References Cited

U.S. PATENT DOCUMENTS 4,007,776 A * 2/1977 Alkasab ..... F24F 5/0046 165/236
6,182,467 B1 2/2001 Zhong et al.
7,506,518 B2 * 3/2009 Mizutani ..... F25B 13/00 62/131
8,104,298 B2 * 1/2012 Sishtla ..... F04D 29/058 62/84

(Continued)

FOREIGN PATENT DOCUMENTS

EP 1400765 A2 3/2004

OTHER PUBLICATIONS

EP Search Report for application EP 19175782.2, dated Nov. 18, 2019, 8 pages.

*Primary Examiner* — Jerry-Daryl Fletcher
*Assistant Examiner* — Daniel C Comings
(74) *Attorney, Agent, or Firm* — Cantor Colburn LLP

(57) ABSTRACT

A refrigeration apparatus, including a main circuit (1) for circulation of a main flow (90) of refrigerant, and a lubrication branch (20), comprising a lubrication inlet (21), configured to derive a lubrication flow (91) from the main flow (90) circulating through a supply part (16) of the main circuit; and a lubrication outlet (22), to feed the compressor (2) with the lubrication flow (91) for lubrication. According to the invention, the refrigeration apparatus further includes: a subcooling branch (40), comprising a subcooling inlet (41), connected to an evaporator (8) of the main circuit (1), so as to derive a subcooling flow (92), and a subcooling outlet (42), connected to the evaporator (8), for reintroducing the subcooling flow (92) into the main flow (90); and a subcooling heat exchanger (31).

11 Claims, 4 Drawing Sheets

(56) References Cited

U.S. PATENT DOCUMENTS

| | | | | |
|---|---|---|---|---|
| 8,677,779 | B2 * | 3/2014 | Lambert | F25B 5/02 62/504 |
| 9,032,753 | B2 * | 5/2015 | Love | F25B 31/026 62/472 |
| 2006/0117790 | A1 * | 6/2006 | Dieterich | F04C 29/021 62/467 |
| 2008/0210601 | A1 | 9/2008 | Shoulders | |
| 2014/0345311 | A1 * | 11/2014 | Sun | F25B 31/006 62/259.2 |
| 2014/0360210 | A1 * | 12/2014 | Lapp | F04D 17/10 62/84 |

* cited by examiner

REFRIGERATION APPARATUS HAVING SUBCOOLING HEAT EXCHANGER FOR LUBRICATION FLOW

FOREIGN PRIORITY

This application claims priority to European Patent Application No. 19175782.2, filed May 21, 2019, and all the benefits accruing therefrom under 35 U.S.C. § 119, the contents of which in its entirety are herein incorporated by reference.

BACKGROUND

The present invention concerns a refrigeration apparatus and the use of said refrigeration apparatus.

The invention relates to the domain of machines that implement a thermodynamic cycle to a refrigerant, for producing a refrigeration effect.

A refrigerating apparatus is known from EP 1 400 765 A2, comprising a refrigerant passage including a screw compressor, a condenser, an expansion valve and an evaporator. This known apparatus comprises a bypass flow passage, branching at a part of said refrigerant passage, between the condenser and the expansion valve, routing the refrigerant through throttle means, and communicating with a rotor cavity of the screw compressor. Lubrication of the rotor cavity is achieved by the same fluid that is also used as the refrigerant in the passage, and in the absence of oil.

For successfully lubricating the rotor cavity, one must ensure that a significant part of the refrigerant reaching the rotor cavity is in a liquid state. This is usually the case when the refrigerating apparatus is operating at high load, corresponding in particular to a high flow of refrigerant. When the refrigerating apparatus is operating at full load, the refrigerant emitted by the condenser is generally entirely in a liquid state, or in a diphasic state with little proportion of the refrigerant in gaseous state.

However, if the need for refrigeration is lower, the apparatus may be operating at low load, including in particular a smaller flow of refrigerant. During low load operation of the apparatus, it may happen that the refrigerant circulating through the bypass flow passage is not entirely in liquid state and contains a non-negligible proportion of refrigerant in gaseous state, or even a high proportion of refrigerant in gaseous state. Since refrigerant in a gaseous state is not able to sufficiently lubricate the compressor, there is a risk of damaging or destroying the compressor due to a lack of lubrication during low load operation of the apparatus.

SUMMARY

An aim of the invention is to provide a refrigeration apparatus where satisfactory lubrication of the compressor by means of the refrigerant is obtained, even during low load operation of the refrigeration apparatus.

An object of the invention is a refrigeration apparatus, comprising a main circuit, including: a compressor, including a compressor inlet and a compressor outlet, a condenser, including a condenser inlet, connected to the compressor outlet, and a condenser outlet, an expansion valve, including a valve inlet, connected to the condenser outlet and a valve outlet, and an evaporator, including an evaporator inlet, connected to the valve outlet, and an evaporator outlet, connected to the compressor inlet.

According to the invention, the main circuit is configured for a loop circulation of a main flow of refrigerant, successively through the compressor, the condenser, the expansion valve, and the evaporator, According to the invention, the refrigeration apparatus further comprises a lubrication branch, comprising: a lubrication inlet, connected to a supply part of the main circuit, the supply part consisting in the condenser, the valve inlet, and any part of the main circuit between the condenser outlet and the valve inlet, the lubrication inlet being configured to derive a lubrication flow from the main flow of refrigerant circulating through the supply part; and a lubrication outlet, connected to the compressor so as to feed the compressor with the lubrication flow, for lubrication of said compressor with the refrigerant of the lubrication flow.

According to the invention, the refrigeration apparatus further comprises: a subcooling branch, comprising: a subcooling inlet, connected to the evaporator, so as to derive a subcooling flow from the main flow of refrigerant circulating through the evaporator, and a subcooling outlet, connected to the evaporator, for reintroducing the subcooling flow into the main flow of refrigerant circulating through the evaporator; and a subcooling heat exchanger, being positioned outside of the evaporator, and being configured for enabling an exchange of heat between the subcooling flow circulating through the subcooling branch and the lubrication flow circulating through the lubrication branch, so that the lubrication flow may be cooled by the subcooling flow within the subcooling heat exchanger.

Thanks to the invention, the lubrication flow, used for lubricating the compressor, is cooled by the subcooling flow prior to introduction of the lubrication flow into the compressor, through the subcooling heat exchanger. Thus, the subcooling heat exchanger ensures that the lubrication flow of the refrigerant is in liquid form or ensures at least that the lubrication flow contains enough refrigerant in liquid form for achieving sufficient lubrication of the compressor. The subcooling flow is derived from the main flow of refrigerant, at a stage where the refrigerant is at the lowest temperature in the main circuit, namely at the evaporator. Thus, the subcooling flow is necessarily at a lower temperature than the lubrication flow. Since the subcooling heat exchanger is located outside of the evaporator, and preferably outside of the main circuit, only little modification of an existing evaporator and main circuit is required for installing the subcooling branch and the subcooling heat exchanger.

The subcooling inlet is positioned at a lower height than the subcooling outlet, so that the subcooling flow is circulated by thermosiphon effect, when the subcooling flow is heated by the lubrication flow within the subcooling heat exchanger. The evaporator comprises an evaporator tank, flooded with refrigerant of the main flow and comprising: a lower part, connected to: the evaporator inlet, for conducting refrigerant of the main circuit into the lower part, and the subcooling inlet, for deriving the subcooling flow from the lower part into the subcooling branch, an upper part, connected to the lower part and connected to: the subcooling outlet, for reintroducing the subcooling flow from the subcooling branch into the upper part, and the evaporator outlet, for discharging the refrigerant from the upper part. The evaporator comprises an outlet duct, connecting the evaporator outlet to the upper part of the evaporator tank, the duct comprising a Venturi-effect passage section reduction, the subcooling outlet being connected radially to the Venturi-effect passage section reduction so that the subcooling flow is sucked into the duct by Venturi-effect, when refrigerant is discharged from the upper part into the evaporator outlet. The subcooling heat exchanger comprises: a heat exchange tank, belonging to a first branch chosen among the lubrication branch and the subcooling branch and being configured so that the flow of refrigerant circulating through the first branch circulates through the heat exchange tank, and a heat exchange passage, belonging to a second branch chosen among the lubrication branch and the subcooling branch and being distinct from the first branch, the heat exchange passage being positioned within the heat exchange tank and being configured so that the flow of refrigerant circulating through the second branch circulates through the heat exchange passage. The first branch is the lubrication branch and the second branch is the subcooling branch. The lubrication branch comprises: an inlet duct, connecting the lubrication inlet to the heat exchange tank, for circulation of the lubrication flow from the lubrication inlet to the heat exchange tank, and comprising an open inlet end positioned within the heat exchange tank for admission of the lubrication flow into the heat exchange tank; and an outlet duct, connecting the heat exchange tank to the lubrication outlet, for circulation of the lubrication flow from the heat exchange tank to the lubrication outlet, and comprising an open outlet end positioned within the heat exchange tank, at a lower height than the open inlet end. The heat exchange tank comprises at least one liquid level sensor, detecting the presence of liquid refrigerant at a respective height within the heat exchange tank. The heat exchange passage is a coil duct. The heat exchange passage comprises a lower inlet, connected to the subcooling inlet, and an upper outlet, connected to the subcooling outlet, the lower inlet and the upper outlet being positioned at a wall of the heat exchange tank, the lower inlet being at a lower height than the upper outlet. The lubrication inlet is connected to a bottom part of the condenser. Wherein the compressor is a positive displacement-type compressor. The compressor is a screw compressor comprising two meshing screw rotors and bearings, the screw rotors being supported by the bearings, and the lubrication outlet is connected to the compressor so as to feed the bearings and the screw rotors with the lubrication flow, for lubrication of said bearings and screw rotors.

An object of the invention is a use of a refrigeration apparatus as defined above, including: closed loop circulation of the main flow of refrigerant successively through the compressor inlet, the compressor, the compressor outlet, the condenser inlet, the condenser, the condenser outlet, the valve inlet, the expansion valve, the valve outlet, the evaporator inlet, the evaporator, and the evaporator outlet; derivation of the lubrication flow from the main flow of refrigerant circulating through the supply part, by the lubrication inlet; circulation of the lubrication flow through the lubrication branch, successively through the lubrication inlet, the subcooling heat exchanger and the lubrication outlet; derivation of the subcooling flow from the main flow of refrigerant circulating through the evaporator, by the subcooling inlet; circulation of the subcooling flow through the subcooling branch, successively through the subcooling inlet, the subcooling heat exchanger and the subcooling outlet; exchange of heat between the subcooling flow and the lubrication flow in the subcooling heat exchanger, so that the lubrication flow is cooled by the subcooling flow; feeding of the compressor, by the lubrication outlet, with the lubrication flow that was cooled by the subcooling flow in the subcooling heat exchanger, for lubrication of the compressor; and reintroduction, by the subcooling outlet, of the subcooling flow that has cooled the lubrication flow in the subcooling heat exchanger, into the main flow of refrigerant circulating through the evaporator.

DRAWING DESCRIPTION

Exemplary embodiments according to the invention and including further advantageous features of the invention are explained below, referring to the attached drawings, wherein.

DETAILED DESCRIPTION

Figure 1:
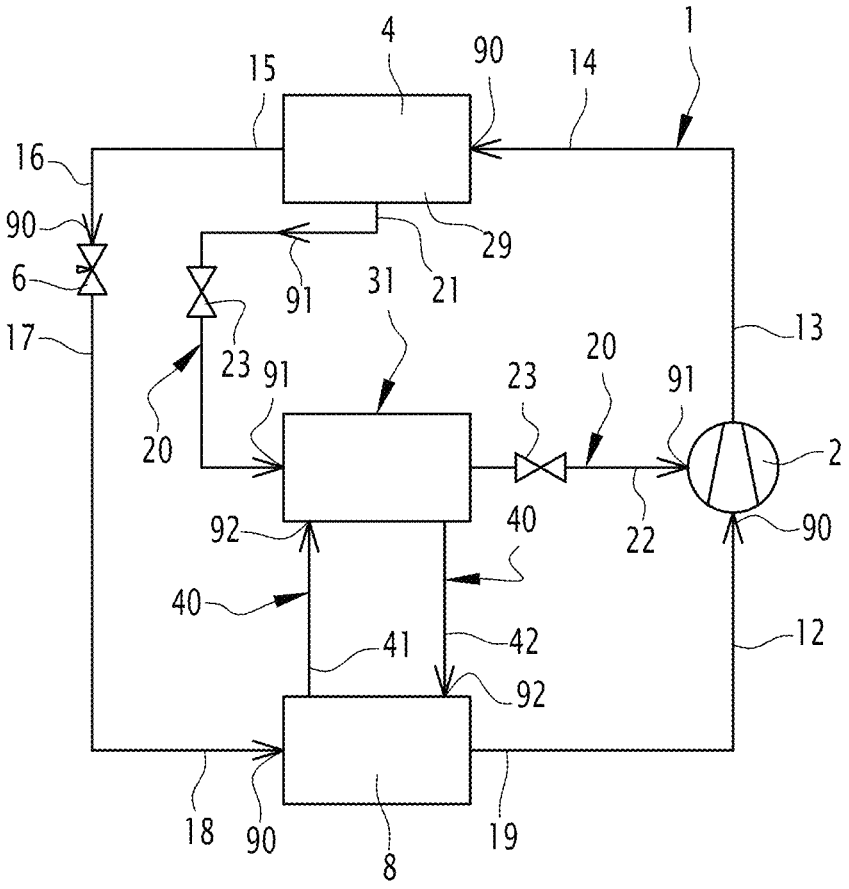
FIG. 1 is a synoptic drawing showing a first embodiment of a refrigeration apparatus according to the invention.

FIG. 1 shows a refrigeration apparatus, comprising a main circuit 1 forming a closed loop for looped circulation of a main flow 90 of refrigerant therein. During the circulation of the main flow 90 of refrigerant through the main circuit 1, the refrigerant endures a thermodynamic cycle imparted by the components of the main circuit 1.

The refrigerant of the refrigeration apparatus is a fluid material chosen to ensure both functions of refrigerant and lubricant. Preferably, the refrigerant used in the apparatus is a hydrofluoroolefin (HFO), for example R 1234ze (1,3,3,3-tetrafluoroprop-1-ene).

The main circuit 1 comprises a compressor 2, a condenser 4, an expansion valve 6 and an evaporator 8. The compressor 2 comprises a compressor inlet 12 and a compressor outlet 13. The condenser 4 includes a condenser inlet 14, connected to the compressor outlet 13, and a condenser outlet 15. The expansion valve 6 includes a valve inlet 16, connected to the condenser outlet 15 and a valve outlet 17. The evaporator 8 includes an evaporator inlet 18, connected to the valve outlet 17, and an evaporator outlet 19, connected to the compressor inlet 12.

For obtaining the thermodynamic cycle of the refrigerant, the flow 90 of the aforementioned refrigerant is circulated through the main circuit 1 in a closed loop, successively through the compressor 2, outlet 13, inlet 14, condenser 14, outlet 15, inlet 16, expansion valve 6, outlet 17, inlet 18, evaporator 8, outlet 19, inlet 12, and through the compressor 2 again, and so on. For this purpose, the refrigerant is compressed by compressor 2. In the figures, the direction of the flow 90 is illustrated by arrows.

Preferably, the circulation of the flow 90 of refrigerant through the main circuit 1 is only imparted by the work of the compressor 2. However, if necessary, additional compressor or pumps may be implemented. More generally, depending on the application, the main circuit 1 may comprise additional components than the compressor 2, condenser 4, expansion valve 6 and evaporator 8, for example, an additional expansion valve, or an additional branch for deriving a portion of the flow 90 from a part of the main circuit to another part of the main circuit, or an additional heat exchanger, that may have an economizer function.

Preferably, in a steady-state, during a high load operation of the refrigerating apparatus: in the compressor 2, the refrigerant is in a gaseous state, and is compressed from a low pressure to a high pressure, which raises the temperature of the refrigerant from a low temperature to a high temperature; in the outlet 13 and in the inlet 14, the refrigerant is in a gaseous state, or essentially gaseous state, is at the high temperature and the high pressure; in the condenser 4, the refrigerant is in a diphasic state, including gaseous and liquid refrigerant, and is condensed to a liquid state by the condenser 4; in the outlet 15 and in the inlet 16, the refrigerant is in a liquid state, or essentially liquid state, is at the high pressure, and may be at the high temperature or at a temperature between the high temperature and the low temperature; in the expansion valve 6, the refrigerant is brought to the low pressure, which lowers the temperature of the refrigerant to the low temperature while evaporating the refrigerant to the diphasic state; in the outlet 17 and in the inlet 18, the refrigerant is in a diphasic-state, where a major part is liquid and a smaller part is gaseous, and the refrigerant is at the low temperature and the low pressure; in the evaporator 8, the refrigerant is in a diphasic state, including gaseous and liquid refrigerant, and is evaporated to a gaseous state by the evaporator 8; in the outlet 19 and in the inlet 12, the refrigerant is in a gaseous state, or essentially gaseous state, at the low pressure and at a low temperature, or at a temperature between the low and the high temperature.

For example, the low temperature is approximately between 5-10° C., the high temperature is approximately between 35-40° C., the low pressure is approximately between 3-4 bar, and the high pressure is approximately between 6-10 bar.

Considering the above, the main circuit 1 comprises a high-pressure part, consisting in the compressor outlet 13, the condenser 4 and the valve inlet 16, and a low pressure part, consisting in the valve outlet 17, the evaporator 8 and the compressor inlet 12.

The main circuit 1 comprises a so-called "supply part", which covers only a portion of the high pressure part, where the refrigerant is mostly in liquid state and high pressure, the supply part preferably consisting in the condenser 4, the valve inlet 16, and any part of the main circuit 1 between the condenser outlet 15 and the valve inlet 16, i.e. downstream from the outlet 15 and upstream from the inlet 16. The supply part advantageously constitutes a part of the circuit 1 where the refrigerant of the flow 90 is in the most appropriate state to be used as lubricant.

Preferably, the compressor 2 is a positive displacement-type compressor, also called volumetric compressor, such as piston compressor, scroll compressor, roots compressor or screw compressor. More preferably, the compressor 2 is a screw compressor, comprising two parallel meshing screw rotors, for imparting compression to the refrigerant. The screw rotors are supported in rotation relative to a frame of the compressor 2 by at least four bearings of the compressor 2, each of the screw rotors being individually supported by two of the four bearings. The compressor 2 is equipped with a motor, driving one of the screw rotors in rotation, the second screw rotor being also driven in rotation by meshing with the first screw rotor.

The compressor 2 is configured to be lubricated by the refrigerant, and not by a separate lubricant. Thus, the compressor 2 may be qualified as an "oil-free compressor". Preferably, the entire refrigeration apparatus is oil-free.

Preferably, the condenser 4 comprises or constitutes a heat exchanger, able to exchange heat between the refrigerant of the main circuit 1 and water, or ambient air, or any other suitable medium able to absorb heat from the main flow 90 of refrigerant circulating through the condenser 4.

Preferably, the evaporator 8 comprises or constitutes a heat exchanger, able to exchange heat between the refrigerant of the main circuit 1 and a thermal charge to be cooled by the refrigerant. The thermal charge may comprise water, or any other substrate to be cooled by the refrigeration apparatus.

The refrigeration apparatus comprises a lubrication branch 20 distinct from the main circuit 1, and connected to the main circuit 1. The lubrication branch 20 is a passage for a flow 91 of refrigerant originating from the main flow 90 of refrigerant of the main circuit 1. The flow 91 is designated as "lubrication flow". The lubrication flow 91 is a flow of refrigerant, formed by a portion of the main flow 90.

The branch 20 comprises an inlet 21, designated as "lubrication inlet" and an outlet 22, designated as "lubrication outlet". The inlet 21 is connected to the main circuit 1 at a bottom part 29 of the condenser 4, which belongs to the supply part of the main circuit 1. Alternatively, the inlet 21 could be connected for example between the condenser 4 and the expansion valve 6, preferably at the condenser outlet 15. Alternatively, for connection of the inlet 21, any portion of the supply part of the main circuit 1 may be chosen, since, in the supply part of the main circuit 1, at least a part of the refrigerant is in liquid phase.

Preferably, the inlet 21 derives the flow 91 from the main flow 90 of refrigerant that has already circulated through the condenser inlet 14, that has already exchanged heat with the water, ambient air or similar medium through the condenser 4, and that has not yet circulated through the condenser outlet 15. More preferably, the inlet 21 derives the flow 91 at the bottom part 29 of the condenser 4 where liquid-state refrigerant from the flow 90 is received by gravity.

In a preferred alternative, the inlet 21 derives the flow 91 from the main flow 90 that circulates through the condenser outlet 15, where there is a good chance that most or all of the refrigerant of the flow 90 is in liquid form.

The flow 91 is introduced into the branch 20 by the inlet 21. The outlet 22 is connected to the compressor 2, for feeding the compressor with the flow 91, for lubrication of said compressor 2 by means of the flow 91. The outlet 22 is connected at inlets of the compressor 2 that differ from the inlet 12, for feeding mechanical parts of the compressor 2 that require lubrication. Preferably, the outlet 22 is connected to inlets of the compressor 2 that feed the bearings and/or the compression cavities formed by the screw rotors, so that they are lubricated by the liquid refrigerant fed by the branch 20.

Optionally, the branch 20 comprises one or more valves 23, such as solenoid valves and/or throttle valves, for adjusting the flow rate of the flow 91 admitted within the branch 20 and introduced into the compressor 2.

As explained above, during high load operation of the apparatus, the flow 91 of refrigerant derived at the inlet 21 is usually liquid. However, at a lower load of the apparatus, the refrigerant of the flow 91 may be diphasic at the inlet 21. For ensuring that, when reaching the compressor 2, the refrigerant of the flow 91 is in liquid form, or is in diphasic form with sufficient proportion of liquid refrigerant, the refrigerant apparatus comprises a heat exchanger 31, designated as "subcooling heat exchanger", and a branch 40, designated as "subcooling branch", for cooling the refrigerant of the flow 91.

The subcooling branch 40 is distinct from the main circuit 1 and from the branch 20, and is connected to the main circuit 1, in particular to the evaporator 8. The branch 40 is a passage for a flow 92 of refrigerant, originating from the main flow 90 of refrigerant of the main circuit 1. The flow 92 is designated as "subcooling flow". The subcooling flow 92 is a flow of refrigerant, formed by a portion of the main flow 90.

The subcooling branch 40 comprises an inlet 41, designated as "subcooling inlet", and an outlet 42, called "subcooling outlet".

The inlet 41 is connected to the main circuit 1 at the evaporator 8, preferably at a part of the evaporator 8 where the refrigerant of the flow 90 is at a quite low temperature, if possible at the lowest temperature. The inlet 41 derives the flow 92 from the flow 90 of refrigerant that has circulated through the inlet 18, and that has not yet circulated through the outlet 19. The flow 92 is introduced into the branch 40 by the inlet 41. At the inlet 41, the refrigerant of the flow 92 is diphasic with a high proportion of liquid, or even liquid.

The outlet 42 is connected to the evaporator 8, for reintroducing the derived flow 92 into the main circuit 1, within the evaporator 8. Preferably, the outlet 42 is connected at a part of the evaporator 8 different from the part of the evaporator where the inlet 41 is connected. At the outlet 42, for the reasons explained below, the refrigerant of the flow 92 is diphasic with a high proportion of gaseous refrigerant, or is even fully gaseous.

The subcooling heat exchanger 31 is configured for enabling or promoting an exchange of heat between the flows 91 and 92, so that the refrigerant of the flow 91 is sub-cooled by exchange of heat with the flow 92 within the subcooling heat exchanger 31. The flows 91 and 92 are not brought into contact or mixed together. Instead, the flows 91 and 92 are circulated close to each other with separation by a thin heat-conductive wall of the heat exchanger 31, promoting heat exchange between the flows 91 and 92. Thus, within the exchanger 31, the flow 91 is cooled by the flow 92, and the flow 92 is heated by the flow 91.

Since the refrigerant of the lubrication flow 91 is cooled in the heat exchanger 31, the apparatus ensures that the refrigerant of the lubrication flow 91 is in liquid-state, or has a high proportion of liquid refrigerant, when entering the compressor 2 at the outlet 22. Even when the apparatus operates at low load, i.e. low flow rate of the flow 90, appropriate lubrication of the compressor 2 is ensured.

The branch 40 may be provided with a suitable valve, such as a throttle valve or solenoid valve, not shown in the figures, for adjusting or disabling the circulation of the flow 92 depending on the current load of the refrigeration apparatus. For example, the circulation of the flow 92 may be interrupted or reduced when the apparatus operates at high load for improving thermal efficiency of the refrigeration apparatus. For example, the circulation of the flow 92 may be enabled or increased when the apparatus operates a low load for improving lubrication of the compressor 2.

Figure 2:
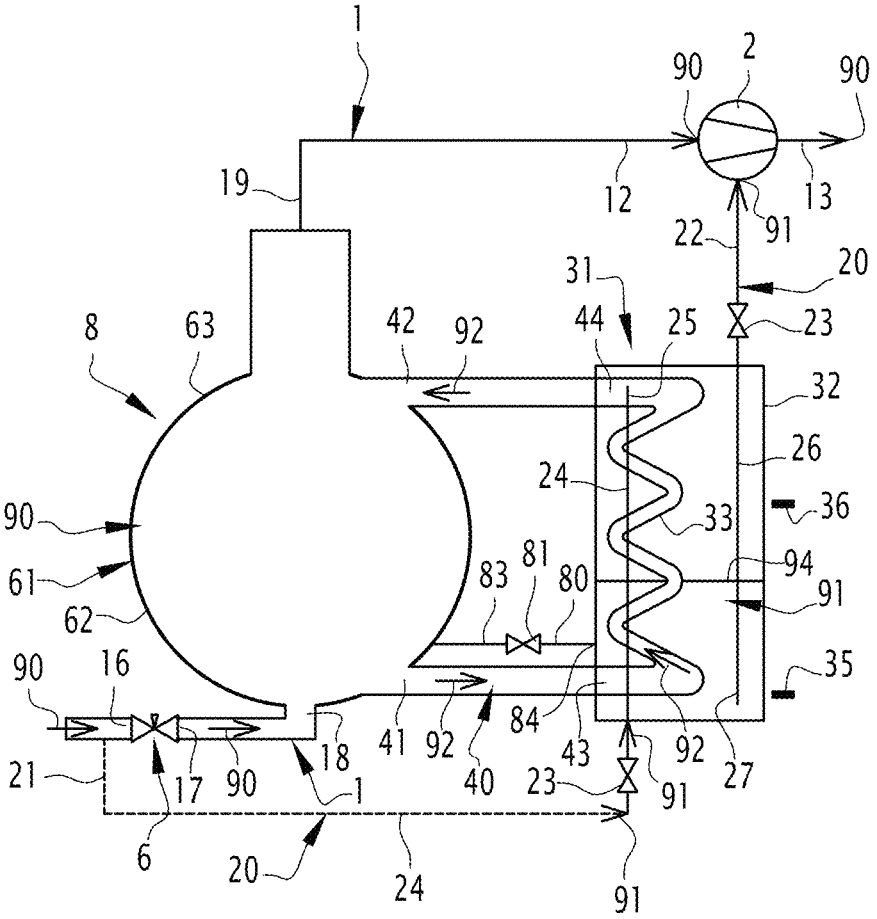
FIG. 2 is a synoptic drawing showing only a part of the refrigeration apparatus of FIG. 1.

As shown in FIGS. 1 and 2, the heat exchanger 31 is positioned outside of the evaporator 8, and preferably outside of the main circuit 1. Thus, implementing the heat exchanger 31 in an existing refrigeration apparatus is made easier, since the evaporator 8 does not need to be modified significantly, but only requires connection with the heat exchanger 31 by means of the branch 40.

Preferably, as shown in FIG. 2, the inlet 41 is positioned at a lower height than the outlet 42, or below the outlet 42. As shown in FIG. 2, the heat exchanger 31 is preferably positioned at the same height than the evaporator 8, for promoting circulation of the flow 92 by thermosiphon effect. More preferably, the inlet 41 is the part of the branch 40 located at the lowest height, while the outlet 42 is the part of the branch 40 located at the highest height. Because the flow 92 is heated during its passage through the heat exchanger 31, a thermosiphon effect occurs, imparting a circulation of the flow 92 from the inlet 41 to the outlet 42. The thermosiphon effect includes that, since the refrigerant of the flow 92 is heated by the refrigerant of the flow 91, the density of the refrigerant of the flow 92 is reduced during its passage through the exchanger 31, by increasing the proportion of gaseous-state refrigerant relative to the liquid-state refrigerant. Thus, the overall refrigerant of the flow 92 is of lower density at the outlet 42 than at the inlet 41. Due to gravity, the refrigerant of lower density tends to rise upwards, to the outlet 42. Moreover, the formation of bubbles within the diphasic refrigerant of the flow 92 within the exchanger 31 may mechanically drain refrigerant upwards, from the inlet 41 to the outlet 42.

Thanks to the position of the inlet 41 and outlet 42 at different heights, the branch 40 does not need to be equipped with circulating means for imparting circulation of the flow 92 through the exchanger 31.

Alternatively however, a circulator may be implemented for circulating the flow 92 through the branch 40.

As shown in FIG. 2, the subcooling heat exchanger 31 preferably comprises a heat exchange tank 32 and a heat exchange passage 33.

In the example of FIG. 2, the tank 32 advantageously belongs to the branch 20, whereas the heat exchange passage 33 advantageously belongs to the branch 40. In other embodiments, such as the embodiment of FIG. 4 discussed below, this may be the opposite. More generally, one branch of the apparatus, chosen among the lubrication branch and the subcooling branch, comprises the tank 32, while the other branch comprises the heat exchange passage 33.

In the case illustrated in FIG. 2, a quantity of refrigerant for lubrication is received by the tank 32, allowing easy measuring of the proportion of liquid refrigerant received in the tank 32. The liquid refrigerant received in the tank 32 may constitute a supply of liquid refrigerant that may be used at operation stages where little liquid refrigerant is available, for example during starting of the refrigeration apparatus.

The flow 91 circulates through the tank 32, when circulating in the branch 20 from the inlet 21 to the outlet 22. For this purpose, the branch 20 preferably comprises an inlet duct 24, connecting the lubrication inlet 21 to the heat exchange tank 32, for circulation of the lubrication flow 91 from the lubrication inlet 21 to the heat exchange tank 32. The duct 24 crosses through a bottom wall of the tank 32 and comprises an open inlet end 25, positioned within the heat exchange tank 32, for admission of the lubrication flow 91 into the heat exchange tank 32 at the vicinity of a top wall of the tank 32. The branch 20 also preferably comprises an outlet duct 26, connecting the heat exchange tank 32 to the lubrication outlet 22, for circulation of the lubrication flow 91 from the heat exchange tank 32 to the lubrication outlet 22. The duct 26 crosses through the top wall of the tank 32 and comprises an open outlet end 27, positioned within the heat exchange tank 32 at the vicinity of the bottom wall of the tank 32. Thus, the outlet end 27 is at a lower height than the inlet end 25.

During operation, the refrigerant of the flow 91 temporarily rests in the tank 32 where heat is exchanged with the flow 92. In the tank 32, the refrigerant of the flow 91 is either fully liquid, in particular during high load operation of the apparatus, or diphasic, in particular during low load operation of the apparatus. When diphasic, the liquid refrigerant sits at the bottom of the tank 32 while the gaseous refrigerant is located at the top. Thus, since the inlet end 25 is located above the outlet end 27, agitation of the refrigerant of the tank 32 is reduced, avoiding reintroduction of gaseous refrigerant into the liquid refrigerant of the tank 32 if the admitted refrigerant is partially gaseous. In addition, with the outlet end 27 being located at the vicinity of the bottom wall of the tank, the risk of admitting gas bubbles into the outlet end 27 is reduced, even if a level 94 of liquid refrigerant in the tank 32 is low.

Preferably, the heat exchange tank 32 comprises two liquid level sensors 35 and 36, each configured for detecting the presence of liquid refrigerant within the heat exchange tank 32, at a respective height. The sensor 35 is configured to detect the presence of liquid refrigerant in the tank at the same height than, or slightly above, the outlet end 27. Thus, the sensor 35 may be used for detecting when the amount of available liquid refrigerant in the tank 32 is too low for correct lubrication of the compressor 2 in steady-state of the refrigeration apparatus, for example during low load operation of the refrigeration apparatus. The sensor 36 is configured to detect the presence of liquid refrigerant in the tank 32 at a higher height than the sensor 35, between the height of the end 25 and the height of the end 27. The sensor 36 may be used for detecting when the amount of available liquid refrigerant in the tank 32 is above or below an acceptable level for starting the refrigeration apparatus, which may require that a high amount of liquid refrigerant is available in the tank 32 for lubrication of the compressor 2. In the case illustrated in FIG. 2, the level 94 of liquid refrigerant received within the tank 32 is at a height comprised between sensors 35 and 36, so that only sensor 35 detects the presence of liquid refrigerant.

If one of the sensors 35 and/or 36 detect that liquid refrigerant is not available at their respective height, operating of the compressor 2 may be interrupted to avoid the risk of damage to the compressor 2.

In a non-shown embodiment, the tank 32 comprises a number of liquid level sensors different than two, each detecting the presence of liquid refrigerant in the tank 32 at a respective height. Alternatively, the tank 32 may be devoid of any liquid level sensor.

The heat exchange passage 33 is positioned within the heat exchange tank 32, so as to be surrounded by the refrigerant of the flow 91. The passage 33 is configured so that the flow 92 of refrigerant circulating through the branch 40 circulates through the passage 33, when circulating from the inlet 41 to the outlet 42. Preferably, as shown in FIG. 2, the passage 33 is a coil duct, promoting heat exchange. The coil duct is preferably made of a material with high heat conductivity such as copper or the like. The coil duct has the advantage that it does not induce too much pressure drop for the flow 92 flowing through. However, instead of a coil duct, any other suitable shape may be implemented for the passage 33, promoting heat exchange without inducing too much pressure drop of the flow 92 and too much agitation for the flow 91 sitting in the tank 32.

The heat exchange passage 33 comprises a lower inlet 43, connected to the subcooling inlet 41 by an inlet duct of the branch 40. The heat exchange passage 33 comprises an upper outlet 44, connected to the subcooling outlet 42 by an outlet duct of the branch 40. The inlet 43 and the outlet 44 are positioned at a peripheral wall of the heat exchange tank 32. The peripheral wall is preferably vertical, and connects the top wall to the bottom wall of the tank 32. For ensuring an efficient thermosiphon effect, the inlet 43 is preferably at a lower height than the outlet 44, as shown in FIG. 2. The inlet 43 is preferably at the same height than the inlet 41, or at a higher height, and the outlet 44 is preferably at the same height than the outlet 42, or at a lower height. The coil duct of the passage 33, connecting the inlet 43 to the outlet 44, is preferably vertical overall. The inlet duct and outlet duct of the branch 40 are preferably horizontal. Overall, the branch 40 is preferably shaped so as to ensure that the flow 92 of the refrigerant is guided to flow in an upwardly inclined direction, and possibly sometimes in a horizontal direction, all along branch 40, from the inlet 41 to the outlet 42. Preferably, the branch 40 never guides the flow in a direction oriented downwards. Thus, an efficient circulation of the flow 92 through the branch 40 under thermosiphon effect is obtained.

Thus, as shown in FIG. 2, the tank 32 and the passage 33 are preferably positioned at the same height than an evaporator tank 61, belonging to the evaporator 8. During operation, due to gravity and thanks to the fluid communication provided by the branch 40, the tank 61 and the passage 33 have liquid at the bottom, and gaseous refrigerant at the top, over the liquid refrigerant.

The valves 23, when both closed, may also be used for temporarily storing refrigerant within the branch 20, in particular within the tank 32 of the heat exchanger 31, especially for periods of time when the refrigeration apparatus is stopped, allowing that liquid-state refrigerant is available in the tank 32 before re-starting. For this purpose, one valve 23 is positioned upstream from the tank 32 and the other valve 23 is positioned downstream of from tank 32.

In a preferred embodiment, the evaporator 8 is a flooded heat exchanger, and the tank 61 is a tank receiving the refrigerant from the flow 90 of the main circuit 1. The evaporator 8 also comprises heat exchange passages, crossing through the tank 61 so as to be surrounded with the refrigerant of the main circuit 1 received within the tank 61. These heat exchange passages are not shown on the figures. Preferably, these heat exchange passages are ducts, so that the evaporator 8 is a flooded tube heat exchanger. Water or any other thermal charge may circulate through these passages so as to be cooled by the refrigerant contained in the tank 61.

Preferably, the tank 61 is of generally cylindrical shape, as this is the case in FIG. 2.

The tank 61 preferably comprises a lower part 62, formed by a lower wall thereof, and an upper part 63, formed by an upper wall thereof, connected to the lower wall for delimiting the internal volume of the tank 61, containing the refrigerant of the flow 90. For example, the lower part 62 is shaped as a lower hemi-cylinder and the upper part 63 is shaped as an upper hemi-cylinder, the hemi-cylinders being connected together along their respective edge for forming the cylindrical tank 61.

The lower part 62 is connected to the evaporator inlet 18, at the bottom of the lower part 62. Thus, the flow 90 of refrigerant coming from the expansion valve 6 is received in the evaporator 8 at the bottom of the tank 61.

The upper part 63 is connected to the evaporator outlet 19, at the top of the upper part 63. Thus, the flow 90 of refrigerant is discharged from the evaporator 8 from the top of the evaporator 8.

In the tank 61, the refrigerant is received in a diphasic state. During operation, the liquid refrigerant sits at the bottom of the tank 61, filling the lower part 62. The gaseous refrigerant is received at the top of the tank 61, filling the upper part 63.

The subcooling inlet 41 is preferably connected to the lower part 62 for deriving the subcooling flow 92 to the subcooling branch 40. Thus, during operation of the apparatus, the inlet 41 is advantageously positioned so as to retrieve liquid refrigerant sitting at the bottom of the tank 61. Consequently, the derived flow 92 is fully, or essentially liquid at the inlet 41, and even at the inlet 43. Thus, the flow 92 derived from the evaporator 8 contains the least quantity of heat, and is susceptible to absorbing a high amount of heat from the flow 91 contained in the tank 32.

When reaching the outlet 42, the refrigerant of the flow 92 is advantageously gaseous. The subcooling outlet 42 is preferably connected to the upper part 63, for receiving the subcooling flow 92 of the refrigerant from the subcooling branch 40, after circulation of said flow 92 through the passage 33. During operation, the outlet 42 is advantageously positioned so that the flow 92 is reintroduced into the tank 61 at a position where the refrigerant of the tank 61 is also gaseous.

Optionally, as shown in FIG. 2, the apparatus may comprise a supplementary branch 80, comprising an inlet 83, connected to the evaporator 8, preferably to the lower part 62 of the tank 61, and an outlet 84, connected to the tank 32. Preferably, the branch 80 is connected close to the bottom of the tank 61, or at the bottom of the tank 61, preferably at the same height or at a lower height than the inlet 41. In FIG. 2, the branch 80 is illustrated above the inlet 41 only for the sake of clarity. During operation, the branch 80 is configured to derive a supplementary flow from the flow 90 of refrigerant from the evaporator 8, by means of the inlet 83, and to introduce this supplementary flow of the flow into the tank 32 by means of the outlet 84, and thus mix the supplementary flow of the flow with the lubrication flow 91.

The supplementary flow is advantageously constituted by liquid refrigerant, or comprises essentially liquid refrigerant, with a very small proportion of gaseous refrigerant. This is why the branch 80 is preferably connected at the bottom of the tank 61, or at the bottom of the evaporator 8.

For enabling circulation of the supplementary flow through the branch 80, the branch 80 is optionally equipped with a non-illustrated circulator. The branch 80 is advantageously provided with a valve 81 for interrupting circulation of the supplementary flow.

During operation, the supply of the supplementary flow is advantageously activated, for example by opening the valve 81, only if the flow 91 does not contain a sufficient proportion of liquid refrigerant, so as to enable lubrication of the compressor 2 with liquid refrigerant originating from the evaporator. This may be used during a starting phase of the apparatus, or during a very low load operation of the apparatus.

Since the branch 80 is connected to the tank 32, the sensors 35 and 36 may detect that liquid refrigerant was successfully introduced into the branch 20. Upon detection of liquid refrigerant by the sensors 35 and 36, starting of the compressor 2 may be authorized.

Figure 3:
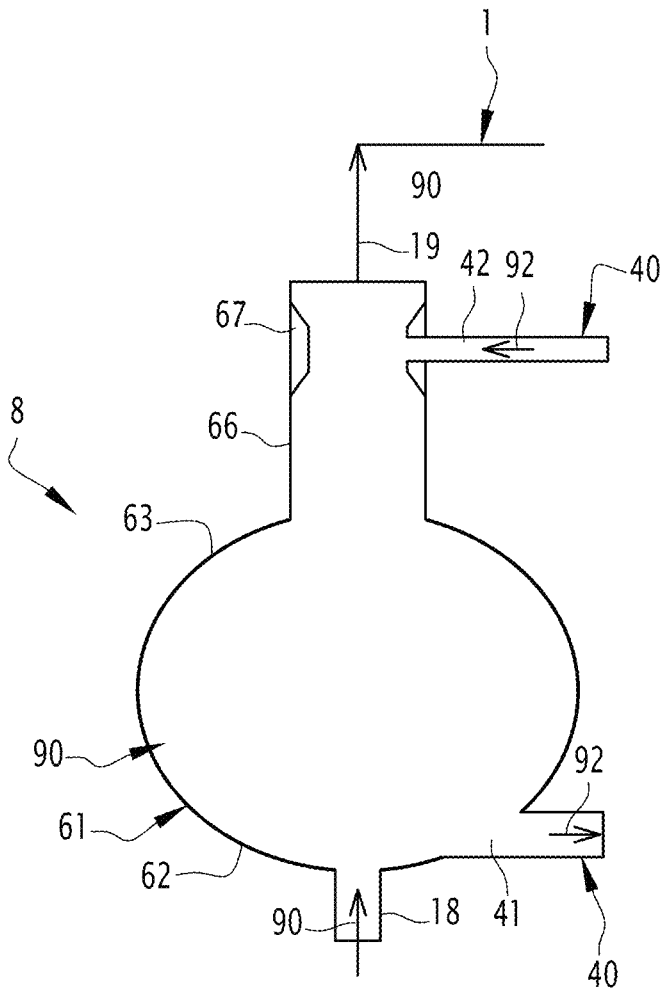
FIG. 3 is a synoptic drawing similar to FIG. 2, showing only a part of a second embodiment of a refrigeration apparatus according to the invention.

The embodiment of FIG. 3 concerns a refrigeration apparatus identical to the apparatus of the embodiment of FIGS. 1 and 2, although the upper part 63 of the evaporator tank 61 and the subcooling outlet 42 are modified.

In the embodiment of FIG. 3, the evaporator 8 comprises an outlet duct 66, connected at the top of the upper part 63 of the evaporator tank 61. The duct 66 connects the upper part 63 of the tank to the evaporator outlet 19. The duct 66 is preferably shaped as a vertical duct, which lower end is connected to the top of the hemi-cylindrical upper part 63.

The duct 66 comprises an internal diameter reduction, or more generally a locally reduced passage section, this passage section reduction 67 producing a Venturi-effect. The reduction 67 is shaped so that, in an upward direction, the passage section is first reduced at the bottom of the reduction 67, and is increased again at the top of the reduction 67. The refrigerant coming from the lower part 62 flows vertically through the reduction 67 after admission at the bottom of the duct 66, and exits from the top of the reduction 67 vertically, into the outlet 19. The subcooling outlet 42 is connected radially to the Venturi-effect diameter reduction 67. In other words, the outlet 42 is connected horizontally, preferably at the part where the diameter of the duct 66 is the most reduced, as shown in FIG. 3. Thus, a Venturi effect is obtained when a vertical flow of refrigerant circulates upwards through the duct 66, through the diameter reduction 67, i.e. when refrigerant is discharged from the upper part 63 into the outlet 19. Thanks to the Venturi effect, the flow 92 is sucked from the subcooling outlet 42 of the branch 40, into the duct 66, towards the outlet 19. Thus, not only the flow 92 is circulated through the branch 40 by thermosiphon effect, but also the Venturi effect increases the circulation of the flow 92 through the branch 40.

Figure 4:
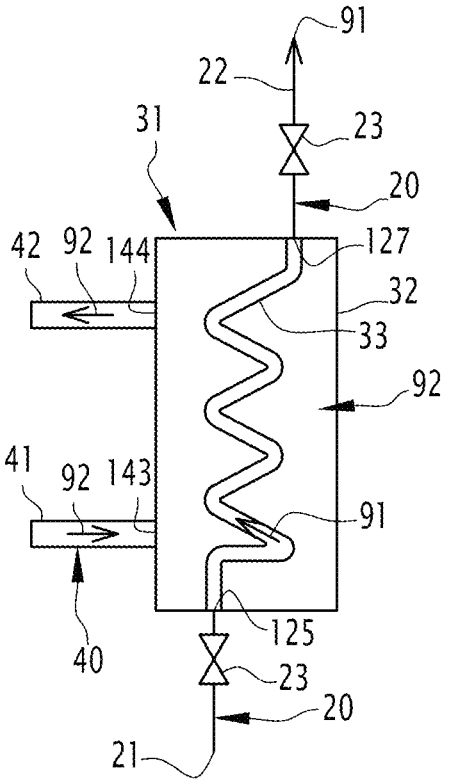
FIG. 4 is a synoptic drawing similar to FIG. 2, showing only a part of a third embodiment of a refrigeration apparatus according to the invention.

The embodiment of FIG. 4 concerns a refrigeration apparatus identical to the apparatus of the embodiment of FIGS. 1 and 2, or to the apparatus of FIG. 3, although the heat exchanger 31 is modified.

In the heat exchanger 31 of FIG. 4, the heat exchange tank 32 is comprised in the subcooling branch 40 instead of the lubrication branch 20, and the heat exchange passage 33 is comprised in the lubrication branch 20 instead of the subcooling branch 40. Thus, when circulating from the inlet 41 to the outlet 42 through the branch 40, the flow 92 circulates through the tank 32. When circulating from the inlet 21 to the outlet 22, the flow 91 circulates through the passage 33. Thus, the flow 92 is received within the tank 32 whereas the flow 91 circulates through the passage 33, contrary to the embodiments of FIGS. 1-3.

The inlet 41 is connected to the tank 32 at a lower inlet 143. The lower inlet 143 is preferably positioned at the same height, or higher height than the inlet 41 The outlet 42 is connected to the tank 32 at an upper outlet 144. The upper outlet is preferably positioned at the same height, or lower height than the outlet 42. The inlet 143 and outlet 144 are preferably positioned at a peripheral wall of the tank 32. The inlet 143 is preferably at a lower height than the outlet 144. The tank 32 is preferably at the same height than the tank 61.

In FIG. 4, the passage 33 is positioned within the tank 32 so as to be surrounded by the flow 92. Here again, the passage 33 is a coil duct. Preferably, the inlet 21 is connected to the passage 33 at a lower inlet 125 of said passage 33, positioned at a bottom wall of the tank 32. Preferably, the outlet 22 is connected to the passage 33 at an upper outlet 127 of said passage 33, positioned at a top wall of the tank 32. The top wall and the bottom wall of the tank 32 are connected by the peripheral wall.

In a non-shown embodiment, the inlet 41 is connected to the evaporator inlet 18.

In a non-shown embodiment, the outlet 42 is connected to the evaporator outlet 19.

Each feature disclosed for an embodiment disclosed above may be implemented in any other embodiment disclosed above, as long as technically feasible.

What is claimed is:

1. A refrigeration apparatus, comprising a main circuit, including:

a compressor, including a compressor inlet and a compressor outlet, a condenser, including a condenser inlet, connected to the compressor outlet, and a condenser outlet, an expansion valve, including a valve inlet, connected to the condenser outlet and a valve outlet, and an evaporator, including an evaporator inlet, connected to the valve outlet, and an evaporator outlet, connected to the compressor inlet, wherein the main circuit is configured for a loop circulation of a main flow of refrigerant, successively through the compressor, the condenser, the expansion valve, and the evaporator, wherein the refrigeration apparatus further comprises a lubrication branch, comprising:

a lubrication inlet, connected to a supply part of the main circuit, the supply part consisting in the condenser, the valve inlet, and any part of the main circuit between the condenser outlet and the valve inlet, the lubrication inlet being configured to derive a lubrication flow from the main flow of refrigerant circulating through the supply part; and a lubrication outlet, connected to the compressor so as to feed the compressor with the lubrication flow, for lubrication of said compressor with the refrigerant of the lubrication flow, wherein the refrigeration apparatus further comprises:

a subcooling branch, comprising:

a subcooling inlet, connected to the evaporator, so as to derive a subcooling flow from the main flow of refrigerant circulating through the evaporator, and a subcooling outlet, connected to the evaporator, for reintroducing the subcooling flow into the main flow of refrigerant circulating through the evaporator; and a subcooling heat exchanger, being positioned outside of the evaporator, and being configured for enabling an exchange of heat between the subcooling flow circulating through the subcooling branch and the lubrication flow circulating through the lubrication branch, so that the lubrication flow may be cooled by the subcooling flow within the subcooling heat exchanger;

wherein the subcooling inlet is positioned at a lower height than the subcooling outlet, so that the subcooling flow is circulated by thermosiphon effect, when the subcooling flow is heated by the lubrication flow within the subcooling heat exchanger;

wherein the evaporator comprises an evaporator tank, flooded with refrigerant of the main flow and comprising:

a lower part, connected to:

the evaporator inlet, for conducting refrigerant of the main circuit into the lower part, and the subcooling inlet, for deriving the subcooling flow from the lower part into the subcooling branch, an upper part, connected to the lower part and connected to:

the subcooling outlet, for reintroducing the subcooling flow from the subcooling branch into the upper part, and the evaporator outlet, for discharging the refrigerant from the upper part, and wherein the evaporator comprises an outlet duct, connecting the evaporator outlet to the upper part of the evaporator tank, the duct comprising a Venturi-effect passage section reduction, the subcooling outlet being connected radially to the Venturi-effect passage section reduction so that the subcooling flow is sucked into the duct by Venturi-effect, when refrigerant is discharged from the upper part into the evaporator outlet.

2. The refrigeration apparatus according to claim 1, wherein the subcooling heat exchanger comprises:

a heat exchange tank, belonging to a first branch chosen among the lubrication branch and the subcooling branch and being configured so that the flow of refrigerant circulating through the first branch circulates through the heat exchange tank, and a heat exchange passage, belonging to a second branch chosen among the lubrication branch and the subcooling branch and being distinct from the first branch, the heat exchange passage being positioned within the heat exchange tank and being configured so that the flow of refrigerant circulating through the second branch circulates through the heat exchange passage.

3. The refrigeration apparatus according to claim 2, wherein the first branch is the lubrication branch and the second branch is the subcooling branch.

4. The refrigeration apparatus according to claim 3, wherein the lubrication branch comprises:

an inlet duct, connecting the lubrication inlet to the heat exchange tank, for circulation of the lubrication flow from the lubrication inlet to the heat exchange tank, and comprising an open inlet end positioned within the heat exchange tank for admission of the lubrication flow into the heat exchange tank; and an outlet duct, connecting the heat exchange tank to the lubrication outlet, for circulation of the lubrication flow from the heat exchange tank to the lubrication outlet, and comprising an open outlet end positioned within the heat exchange tank, at a lower height than the open inlet end.

5. The refrigeration apparatus according to claim 2, wherein the heat exchange tank comprises at least one liquid level sensor, detecting the presence of liquid refrigerant at a respective height within the heat exchange tank.

6. The refrigeration apparatus according to claim 2, wherein the heat exchange passage is a coil duct.

7. The refrigeration apparatus according to claim 2, wherein the heat exchange passage comprises a lower inlet, connected to the subcooling inlet, and an upper outlet, connected to the subcooling outlet, the lower inlet and the upper outlet being positioned at a wall of the heat exchange tank, the lower inlet being at a lower height than the upper outlet.

8. The refrigeration apparatus according to claim 1, wherein, for being connected to the supply part, the lubrication inlet is connected to a bottom part of the condenser.

9. The refrigeration apparatus according to claim 1, wherein the compressor is a positive displacement compressor.

10. The refrigeration apparatus according to claim 1, wherein:

the compressor is a screw compressor comprising two meshing screw rotors, the screw rotors being supported by bearings, and the lubrication outlet is connected to the compressor so as to feed the bearings and the screw rotors with the lubrication flow, for lubrication of said bearings and screw rotors.

11. A use of a refrigeration apparatus according to claim 1, including:

closed loop circulation of the main flow of refrigerant successively through the compressor inlet, the compressor, the compressor outlet, the condenser inlet, the condenser, the condenser outlet, the valve inlet, the expansion valve, the valve outlet, the evaporator inlet, the evaporator, and the evaporator outlet;

derivation of the lubrication flow from the main flow of refrigerant circulating through the supply part, by the lubrication inlet;

circulation of the lubrication flow through the lubrication branch, successively through the lubrication inlet, the subcooling heat exchanger and the lubrication outlet;

derivation of the subcooling flow from the main flow of refrigerant circulating through the evaporator, by the subcooling inlet;

circulation of the subcooling flow through the subcooling branch, successively through the subcooling inlet, the subcooling heat exchanger and the subcooling outlet;

exchange of heat between the subcooling flow and the lubrication flow in the subcooling heat exchanger, so that the lubrication flow is cooled by the subcooling flow;

feeding of the compressor, by the lubrication outlet, with the lubrication flow that was cooled by the subcooling flow in the subcooling heat exchanger, for lubrication of the compressor; and reintroduction, by the subcooling outlet, of the subcooling flow that has cooled the lubrication flow in the subcooling heat exchanger, into the main flow of refrigerant circulating through the evaporator.

* * * * *